United States Patent [19]

Harrison

[11] 4,372,236

[45] Feb. 8, 1983

[54] THREAD CUTTING DEVICE FOR SEWING MACHINE

[75] Inventor: William E. Harrison, Henderson, N.C.

[73] Assignee: Interco Incorporated, St. Louis, Mo.

[21] Appl. No.: 309,356

[22] Filed: Oct. 7, 1981

[51] Int. Cl.[3] ..... D05B 65/02

[52] U.S. Cl. ..... 112/291; 112/235; 112/299

[58] Field of Search ..... 112/291, 294, 297, 288, 112/299, 235

[56] References Cited

U.S. PATENT DOCUMENTS

| | | | |
|---|---|---|---|
| 2,088,266 | 7/1937 | Jafferian | 112/291 |
| 2,282,200 | 5/1942 | Neuman | 112/299 X |
| 2,999,473 | 9/1961 | Wanner | 112/288 |

FOREIGN PATENT DOCUMENTS

| | | | |
|---|---|---|---|
| 525789 | 3/1929 | Fed. Rep. of Germany | 112/299 |
| 1092848 | 4/1955 | France | 112/297 |

*Primary Examiner*—Werner H. Schroeder
*Assistant Examiner*—Andrew M. Falik
*Attorney, Agent, or Firm*—Donald J. Fitzpatrick

[57] ABSTRACT

A thread cutting device for a sewing machine that will cut threads in a scissor-like action. The device is mounted on a sewing machine pressure arm and can be manually operated. The device comprises a stationary horizontal cutting blade; a pivoting cutting blade is attached to the stationary blade so as to form a cutting field and a finger pressure assembly, having a tensioning means, creates a scissor-like action in the cutting field.

3 Claims, 5 Drawing Figures

FIG. 1
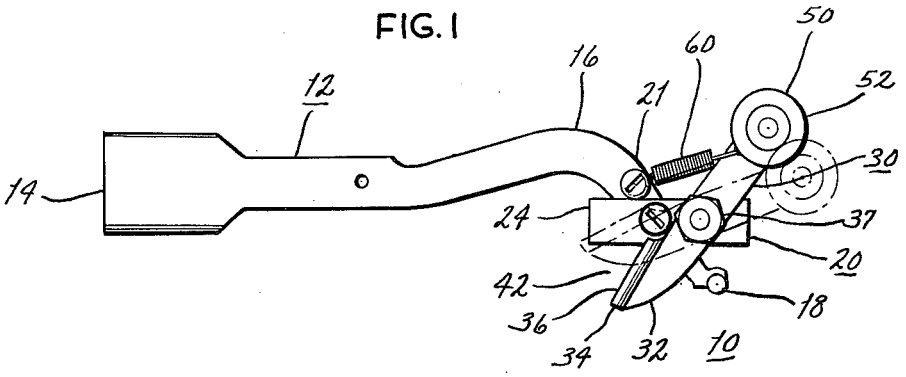
FIG. 2
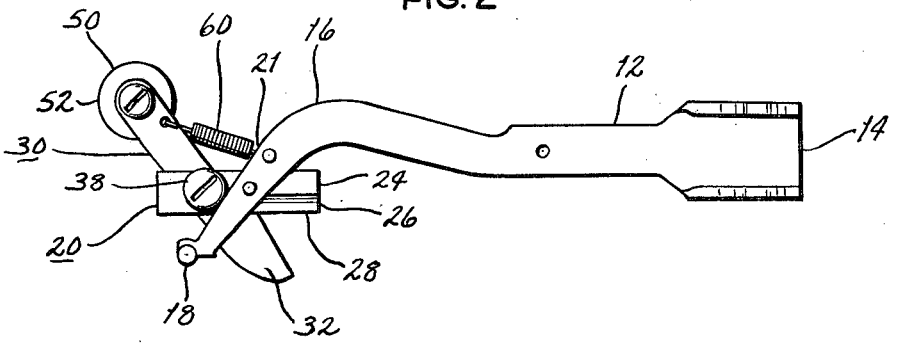
FIG. 3
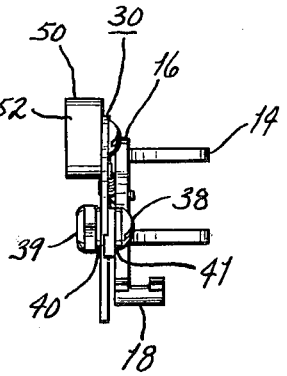
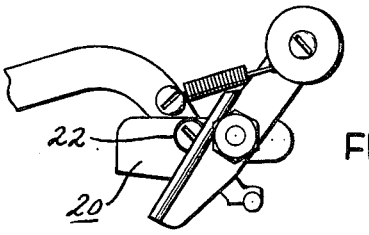
FIG. 4
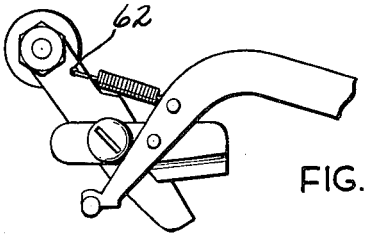
FIG. 5

THREAD CUTTING DEVICE FOR SEWING MACHINE

BACKGROUND OF THE INVENTION

1. Field of the Invention

The present invention relates to a device for cutting threads formed on a sewing machine and, more particularly, to a device for cutting, in a scissor-like action, a serging chain comprised of two or more threads.

2. Description of the Prior Art

The prior art discloses a wide variety of devices that are used in combination with sewing machines to cut or sever threads. For example, in U.S. Pat. No. 2,423,001, issued to Blowers, a series of enchained thread loops are severed by means of a sharp cutting blade. Still further, U.S. Pat. No. 2,508,236, issued to Enos, discloses a thread-severing and nipping member of thin spring steel. Both of these references disclose devices for severing thread. A problem associated with these prior art devices, is that the threads are broken by pulling them under tension across a severing, or cutting, edge which frequently results in a poor cut. As the thread cutting, or severing, device gets dull and loses its sharp edge, the incidence of poor cuts increase. In addition, as multiple threads are cut, as in the instance of three-thread chains used for a serge seam, a smooth, more precise cut is required. This type of cut is often difficult to obtain by severing the threads.

A multi-thread chain of three, four or five threads is normally used on the assembly of fabric on an overlock sewing machine. These chains are typically $\frac{1}{8}$th to $\frac{1}{4}$th inch in diameter and are cut with a pull back knife normally supplied by the sewing machine manufacturer. It has been found to be tedious and difficult to make a smooth cut with this type of severing device. To sever the chain requires pulling the chain under tension across the cutting edge of the pull back knife. Too little thread control tension results in a flat sewn seam but having inconsistent quality. Too much thread control tension results in a puckered seam, but having a satisfactory out.

Various electro-mechanical devices, electric clippers and impact cutters can produce smooth and uniform cuts. These devices are expensive to purchase and maintain. Thus, there is a need for an inexpensive chain cutting device that yields consistent and uniform thread chains.

SUMMARY OF THE INVENTION

The thread cutting device of this invention is inexpensive and cuts threads in a scissor-like action. The invention is mounted on a sewing machine pressure arm and comprises a stationary, essentially horizontal, cutting blade positioned thereon and a pivoting cutting blade is attached to the stationary blade in a cutting relationship, thus forming a cutting field. A hand operated finger pressure assembly creates a scissor-like cutting action within the cutting field. A tensioning means is used to maintain the pivoting blade away from the stationary blade after completion of each thread cut.

It is, therefore, an object of this invention to provide a device that cuts threads in a scissor-like action.

It is another object of this invention to provide a thread cutting device which can be manually operated by a sewing machine operator.

A still further object of this invention is to provide a thread cutting device which can be connected to a sewing machine pressure arm.

These and other objects will become apparent from the description of the invention as hereinafter more fully described.

BRIEF DESCRIPTION OF THE DRAWINGS

The above, and other objects, features and advantages of the present invention will become more readily apparent from the following descriptions of an embodiment of the invention in conjunction with the accompanying drawings, wherein:

FIG. 1 is a front elevation view of the thread cutting device of this invention showing the scissor-like action of the blades. This Figure also shows a phantom view pivoting blade movement.

FIG. 2 is a rear elevation view of the thread cutting device of this invention.

FIG. 3 is an end elevation view showing in detail the pressure assembly.

FIG. 4 is a front elevation view showing the cutting blades and pressure bar.

FIG. 5 is a rear elevation view showing the cutting blades and pressure bar.

DESCRIPTION OF THE PREFERRED EMBODIMENT

FIGS. 1 and 2 show a thread cutting device 10 consisting of the following principal elements: stationary horizontal blade 20, pivoting blade 30 and finger pressure assembly 50.

As these Figures illustrate, a pressure arm 12 is provided for connecting the device to the sewing machine (not shown). This arm has a channel shaped adapter end 14 and a curved portion 16 that terminates at a pressure bar 18. The pressure arm is a standard component of overlock sewing machines and as such, does not constitute an element of this invention. The pressure arm is positioned on the sewing machine by means of the adapter end 14.

As shown in FIGS. 1 and 4, the stationary horizontal blade 20 is fastened to a lower segment 21 of the pressure arm by a threaded fastener 22. The blade has a flat face portion 24 and an oppositely disposed bevelled cutting portion 26. The juncture of the flat portion and bevelled portion forms cutting edge 28.

The pivoting blade 30 has a flat face portion 32 that mates with flat face portion 24 of the stationary blade and an oppositely disposed bevelled cutting portion 34. The juncture of the flat portion and bevelled portion 34 forms a cutting edge 36. FIG. 3 shows in detail that blade 30 is fastened to the stationary blade at 37 by a shouldered machine screw 38 having a lock nut 39 and nylon bushings 40 and 41. A pivoting action is thereby established at one end of the fixed blade, thus forming a cutting field 42 between blades 20 and 30.

Finger pressure assembly 50, comprising a rubber sleeve 52, is fastened to one end of the pivoting blade. When finger pressure is applied to this assembly by a sewing machine operator, blade 30 is caused to pivot about shoulder machine screw 38, thus bringing blades 20 and 30 into a cutting relationship and creating a scissor-like portion within the cutting field. A portion of FIG. 1 is a phantom view that shows the movement of the pivoting blade after finger pressure has caused the blade to pivot.

The blades are maintained in a non-cutting relationship by tensioning means 60, a helical spring fastened at one end to point 62, adjacent the rubber sleeve 52 on the pivoting blade and at the opposite end to the curved portion 16 of the pressure arm. When the finger pressure assembly is depressed, the spring is placed under tension and a scissor-like action is created. The phantom portion of FIG. 1 shows the position of the blades at this step. When pressure is released, the spring retracts and the pivoting blade moves into a non-cutting relationship.

This invention may be practiced according to the following, but not limited, embodiment. The cutting blades are maintained in a non-cutting relationship until the sewing machine operator determines that a thread chain must be cut. When a cut is to be made, the operator places the thread chain into cutting field 42 and then depresses the finger pressure assembly 50. A scissor-like action is thus created by pivoting blade 30 and stationary blade 20 resulting in the thread chain being neatly cut. When the operator removes finger pressure, the tensioning spring 60 causes the pivoting blade to retract into a non-cutting relationship. The device is now ready to perform another cut.

Various modifications of the invention in addition to those shown and described herein, will become apparent to those skilled in the art from the foregoing description. Such modifications are intended to fall within the scope of the appended claims.

I claim:

1. A thread cutting device for use in combination with a sewing machine pressure arm comprising:

a stationary, essentially horizontal blade fastened to said pressure arm and having a lower cutting edge;

a pivoting blade attached to said stationary blade, having a lower cutting edge that forms a cutting field with said stationary blade;

pressure means for causing said pivoting blade to move into a cutting relationship with said stationary blade; and tensioning means for maintaining said blade in a non-cutting relationship.

2. The thread cutting device of claim 1 wherein said pressure means is fastened to said pivoting blade.

3. The thread cutting device of claim 1 wherein said tensioning means is a spring fastened at one end to said pivoting blade and at the other end to said pressure arm.

* * * * *